United States Patent [19]

Horodysky et al.

[11] Patent Number: 4,473,377

[45] Date of Patent: Sep. 25, 1984

[54] ZWITTERIONIC QUATERNARY AMMONIUM CARBOXYLATES, THEIR METAL SALTS AND LUBRICANTS AND FUELS CONTAINING SAME

[75] Inventors: Andrew G. Horodysky, Cherry Hill; Joan Kaminski, Mullica Hill, both of N.J.

[73] Assignee: Mobil Oil Corporation, New York, N.Y.

[21] Appl. No.: 393,898

[22] Filed: Jun. 30, 1982

[51] Int. Cl.[3] ..... C10L 1/22

[52] U.S. Cl. ..... 44/53; 252/34.7; 44/71

[58] Field of Search ..... 44/53, 71

[56] References Cited

U.S. PATENT DOCUMENTS

| | | | |
|---|---|---|---|
| 2,792,400 | 5/1957 | DeGroote et al. | 44/71 |
| 2,951,751 | 9/1960 | McDermott | 44/71 |
| 3,158,647 | 11/1964 | Myers | 44/71 |
| 3,317,291 | 5/1967 | Marsh | 44/72 |
| 3,387,954 | 6/1968 | Capowski | 44/72 |

*Primary Examiner*—Mrs. Y. Harris Smith

*Attorney, Agent, or Firm*—Alexander J. McKillop; Michael G. Gilman; Claude E. Setliff

[57] ABSTRACT

Hydrocarbyl ammonium hydrocarbyl carboxylate internal salts and their metal-containing derivatives are made by reacting certain amines with certain organic acids to obtain the former and reacting that product with a metal oxide or salt to obtain the latter. These are used in lubricants and liquid fuel compositions for a variety of purposes, including reduced friction.

6 Claims, No Drawings

ZWITTERIONIC QUATERNARY AMMONIUM CARBOXYLATES, THEIR METAL SALTS AND LUBRICANTS AND FUELS CONTAINING SAME

BACKGROUND OF THE INVENTION

1. Field of the Invention

The invention is concerned with a novel group of compounds and their use in lubricants or liquid fuels as friction reducers, antioxidants and antiwear, and anti-corrosion additives (i.e., non-corrosive to copper.)

2. Discussion of the Related Art

It is known that sliding or rubbing metal or other solid surfaces are subject to wear under conditions of extreme pressure. Wearing is particularly acute in modern engines in which high temperatures and contact pressures are prevalent. Under such conditions, severe erosion of metal surfaces can take place even with present generation lubricants unless a load carrying or antiwear additive is present herein.

Friction is also a problem any time two surfaces are in sliding or rubbing contact. It is of special significance in an internal combustion engine and related power train components, because loss of a substantial amount of the theoretical mileage possible from a gallon of fuel is traceable directly to friction.

With respect to the novel compounds of this invention, no art is known that teaches or suggest them. Nor is any art known that teaches or suggests their use in a lubricant or a liquid fuel.

SUMMARY OF THE INVENTION

In accordance with the invention, there is provided a compound of one of the formulas

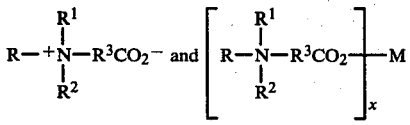

wherein R is a hydrocarbyl group containing 8 to 20 carbon atoms, $R^1$ and $R^2$ are hydrogen or the same or different alkyl groups containing 1 to 10 carbon atoms, $R^3$ is $C_2$ to $C_6$ alkyl group or a benzyl group, x is the valence of M and M is a metal cation. R is preferably an alkyl group, but may also be an aryl or a substitued aryl group.

The invention also provides a lubricant or liquid hydrocarbon fuel composition comprising a lubricant or fuel and a friction reducing or antiwear amount of the product. It is further contemplated that the product will aid in the reduction of fuel consumption in an internal combustion engine.

DESCRIPTION OF SPECIFIC EMBODIMENTS

The compounds of this invention are internal zwitterionic materials and can be purchased or made by reacting an amine with an acid. For example the material of Example 1 [N-(2-carboxy-1-methylethyl)N-coco ammonium inner salt] is made by reacting cocoamine with butenoic acid. The salt, as for example the calcium salt, can be prepared by reacting a compound like that of Example 1 with calcium oxide.

The first reaction, i.e., between the amine and the acid can be carried out at from about 90° C. to about 160° C., preferably from about 120° C. to about 140° C. The temperature chosen will depend in large measure on the particular reactants and on whether or not a solvent is used. In carrying out this reaction, it is preferable that quantities of reactants be chosen such that the ratio of amine to acid will be about 1:1. For example, in the reaction illustrated 1 mole of amine and 1 mole of acid are required.

The second reaction, i.e., the reaction of the initial product with a metal compound to form the salt, can be carried out at from about 60° C. to about 110° C., the initial product to metal compound may range from about 1:2 to about 1:0.5, preferably from about 1:1 to about 1:0.6.

The metal compound can be an oxide, hydroxide or salt, the latter including those having the nitrate, halide, sulfate or phosphate moiety as the anion. The metal can be one from Group IA, IIA, IIB, VIB AND VIII of the Periodic Table. Examples of metals from the respective groups are sodium, calcium, magnesium, zinc, molybdenum and nickel.

While atmospheric pressure is generally preferred, the reaction can be advantageously run at from about 1 to about 5 atmospheres. Furthermore, as mentioned above, where conditions warrant it, a solvent may be used. In general, any realively non-polar, unreactive solvent can be used, including toluene, xylene and 1,4-dioxane.

The times for the reactions are not critical. Thus, any phase of the process can be carried out in from about 2 to about 8 hours.

Of particular significance, in accordance with the present invention, is the ability to improve the resistance to oxidation and corrosion of oleaginous materials such as lubricating media which may comprise liquid oils, in the form of either a mineral oil or a synthetic oil, or mixtures thereof, or in the form of a grease in which any of the aforementioned oils are employed as a vechicle. In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylehexyl) sebacate, di(2-ethylhexyl) adipate, dibutyl phthalate, flourocarbons, silicate esters, silanes, esters of phosphorous-containing acids, liquid ureas ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

It is to be understood, however, that the compositions contemplated herein can also contain other materials. For example, corrosion inhibitors, extreme pressure agents, viscosity index improvers, pour depressants, coantioxidants, antiwear agents and the like can be used, including but not limited to phenates, sulfonates, succinimides, zinc dialkyl dithiophosphates, polymethacrylates, olefin copolymers and the like. These materials do not detract from the value of the compositions of this invention, rather the materials serve to impart their customary properties to be particular compositions in which they are incorporated.

Mineral oil heat exchange fluids particularly contemplated in accordance with the present invention have the following characteristics: high thermal stability, high initial boiling point, low viscosity, high heat-carrying ability and low corrosion tendency.

Further, the transmission fluids of consequence to the present invention are blends of highly refined petroleum base oils combined with VI improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2; RR 1005 on "Automatic Transmission Fluid/Power Transmission Fluid Property and Performance Definitions." Specifications for low-temperature and airfcraft fluids are defined in U.S. Government Specification No. MIL-H-5606A.

In addition, the oxidation and corrosion resistance of functional fluids such as hydraulic fluids can be improved by the adducts of the present invention.

The fuels that may be used for the purposes of this invention include (1) liquid hydrocarbon fuel, such as diesel oil, fuel oil and gasoline, (2) alcohol fuels such as methanol and ethanol and (3) mixtures thereof.

In general, the reaction products of the present invention may be employed in lubricants in any amount which is effective for imparting the desired degree of friction reduction or antiwear activity. In many aplications, however, the product is effectively employed in amounts from about 0.1% to about 10% by weight, and preferably from about 1% to about 5% of the total weight of the lubricant composition.

Concentrations in fuels can range from about 11*b* per 1,000 bbl of fuel to about 300 lbs. per 1,000 bbl of fuel, but preferably from about 2 to 35 lbs. per 1.000 bbl of fuel.

The following Examples will present illustrations of the invention. They are illustrative only, and are not meant to limit the invention.

EXAMPLE 1

N-(2-carboxy, 1-methylethyl)N-coco ammonium inner salt can be obtained commercially or by reacting cocoamine with butenoic acid. Cocoamine is also a commercially obtainable product. One such product sold by Armak Chemical Company, has an iodine value of about 12, 95% primary amine and a combining weight of 210.

EXAMPLE 2

Synthesis of Ca salt of N-(2-carboxy, 1-methylethyl)N-coco ammonium inner salt

Approximately 300 g of N-(2-carboxy, 1-methylethyl)N-coco ammonium inner salt (Example 1) and 46 g of calcium oxide were refluxed in 181 g of toluene and 19 g of isopropanol solvents for 17 hours. The reaction solution was filtered through diatomaceous earth. Solvents were removed by vacuum distillation yielding a pale orange, clear, viscous fluid.

EVALUATION OF THE COMPOUNDS

The compounds were evaluatad in a low velocity Friction Apparatus (LVFA) in a fully formulated 5W-30 synthetic automative engine oil containing an additive package including antioxidant, dispersant and detergent and having the following general characteristics:

Viscosity@100° C.—11.0
Viscosity@40° C.—58.2
Viscosity Index—172

The test compound was 2 and 4% of the total weight of oil.

Description

The Low Velocity Friction Apparatus (LVFA) is used to measure the coefficient of friction of test lubricants under various loads, temperatures, and sliding speeds. The LVFA consists of flat SAE 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain guage system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cammotor arrangement.

Procedure

The rubbing surfaces and 12-13 ml of test lubricants are placed on the LVFA. A 240 psi load is applied, and the sliding speed is maintained at 40 fpm at ambient temperature for a few minutes. A plot of coefficients of friction ($U_k$) vs. speed were taken at 240, 300, 400, and 500 psi. Freshly polished steel specimens are used for each run. The surface of the steel is parallel ground to 4 to 8 microinches. The results in Table 1 refer to percent reduction in friction compared to the unmodified oil. That is, the formulation mentioned above was tested without the compound of this invention and this became the basis for comparison. The results were obtained at 250° F. and 500 psi.

TABLE 1

| Medium and Additive | Friction Evaluation Test: Additive Conc., Wt. % | Reduction or % Change in Coefficient of Friction: 5 Ft./Min. | 30 Ft./Min. |
|---|---|---|---|
| Base Oil (SAE 5W-30) | — | 0 | 0 |
| Example 1* | 2 | 30 | 27 |
| Example 2* | 4 | 21 | 18 |

*In the base fluid

It is apparent from the above that the products of this invention are effective in a variety of uses. That is, they reduce friction and thereby help to decrease fuel consumption, they may be effective antioxidants and should not be corrosive to copper.

We claim:

1. A liquid alcohol fuel composition comprising a major proportion of a liquid alcohol fuel selected from the group consisting of methanol and ethanol and a friction reducing amount of a compound selected from the formulas

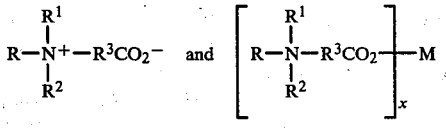

wherein R is a hydrocarbyl group containing 8 to 20 carbon atoms, $R^1$ and $R^2$ are hydrogen or alkyl groups containing 1 to 10 carbon atoms, $R^3$ is an alkylene group having 2 to 6 carbon atoms or a benzyl group, x is the valence of M and M is a metal cation.

2. The composition of claim 1 wherein R is an alkyl or aryl group.

3. The composition of claim 1 wherein M is a metal selected from Groups IA, IIA, IIB, VIB AND VIII.

4. The composition of claim 3 wherein the metal is Na, Ca, Mg, Zn, Mo or Ni.

5. The composition of claim 1 wherein the compound is N-(2-carboxy, 1-methylethyl)N-coco ammonium inner salt.

6. The composition of claim 1 wherein the compound is the Ca salt of N-(2-carboxy, 1-methylethyl)-N-coco ammonium inner salt.

* * * * *

UNITED STATES PATENT AND TRADEMARK OFFICE

CERTIFICATE OF CORRECTION

PATENT NO. : 4,473,377

DATED : September 25, 1984

INVENTOR(S) : Andrew G. Horodysky et al.

It is certified that error appears in the above-identified patent and that said Letters Patent is hereby corrected as shown below:

Column 2, line 24, "realively" should read -- relatively --.

Column 2, lines 37-38, "vechicle" should read -- vehicle --.

Column 4, line 53, "guage" should read -- gauge --.

Signed and Sealed this

*Thirtieth* Day of *April 1985*

[SEAL]

*Attest:*

DONALD J. QUIGG

*Attesting Officer* *Acting Commissioner of Patents and Trademarks*